US006843330B2

(12) United States Patent
Schmid et al.

(10) Patent No.: US 6,843,330 B2
(45) Date of Patent: Jan. 18, 2005

(54) HAMMER DRILL AND/OR PAVING BREAKER WITH A HANDLE

(75) Inventors: Wolfgang Schmid, Munich (DE); Rudolf Berger, Grunwald (DE); Peter Weyl, Stockdorf (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/473,635

(22) PCT Filed: Jul. 24, 2002

(86) PCT No.: PCT/EP02/08255

§ 371 (c)(1),
(2), (4) Date: Sep. 26, 2003

(87) PCT Pub. No.: WO03/011531

PCT Pub. Date: Feb. 13, 2003

(65) Prior Publication Data

US 2004/0104033 A1 Jun. 3, 2004

(30) Foreign Application Priority Data

Jul. 26, 2001 (DE) ..... 101 36 515

(51) Int. Cl.[7] ..... B25D 9/00

(52) U.S. Cl. ..... 173/217; 173/201; 173/170; 173/109

(58) Field of Search ..... 173/201, 48, 109, 173/116, 170, 217

(56) References Cited

U.S. PATENT DOCUMENTS

| | | | | |
|---|---|---|---|---|
| 3,161,242 A | * | 12/1964 | Etzkorn et al. | 173/109 |
| 3,203,490 A | | 8/1965 | McCarthy | |
| 3,376,939 A | * | 4/1968 | Jakob | 173/201 |
| 4,113,035 A | * | 9/1978 | Stiltz et al. | 173/201 |
| 4,456,076 A | * | 6/1984 | Schmid et al. | 173/201 |
| 4,567,951 A | * | 2/1986 | Fehrle et al. | 173/201 |
| 5,775,440 A | * | 7/1998 | Shinma | 173/109 |
| 6,044,918 A | | 4/2000 | Noser | |
| 6,112,830 A | * | 9/2000 | Ziegler et al. | 173/109 |
| 6,237,699 B1 | * | 5/2001 | Plietsch et al. | 173/201 |
| 6,484,814 B2 | * | 11/2002 | Bongers-Ambrosius | 173/2 |

FOREIGN PATENT DOCUMENTS

| | | |
|---|---|---|
| DE | 25 06 057 A | 8/1976 |
| GB | 2 154 497 A | 11/1985 |

* cited by examiner

*Primary Examiner*—Scott A. Smith
(74) *Attorney, Agent, or Firm*—Boyle Fredrickson Newholm Stein & Gratz S.C.

(57) ABSTRACT

The invention relates to a handheld hammer drill and/or paving breaker which is at least of average weight and power class and which comprises an electric motor, a striking tool which can be actuated by the electric motor and a housing wherein the electric motor and the striking tool are received. A handle is embodied in such a way on the housing that a holding position is arranged in a projection of the striking axis of the striking tool. A rotating axis of a motor shaft of an electric motor is parallel to the axis of the striking axis, the total length of the hammer drill and/or striking hammer being small in the longitudinal direction.

6 Claims, 4 Drawing Sheets

HAMMER DRILL AND/OR PAVING BREAKER WITH A HANDLE

BACKGROUND OF THE INVENTION

1. Field of the Invention

The present invention relates to a manually operated hammer drill and/or paving breaker according to the preamble of patent claim 1.

2. Description of Related Art

Hammer drills and/or paving breakers, hereinafter briefly designated "hammers," are manufactured in accordance with many different constructive designs, depending on their intended use. Hammers having low electrical power consumption and light weight are generally realized in "pistol form," having a handle. However, if higher performance demands are made on a hammer of this sort, a correspondingly enlarged diameter of an electric motor (generally a standard universal motor) used in the hammer leads to a disadvantageous large spacing between a percussion mechanism axis and the handle. As a consequence, in hammers having greater electrical power consumption that are built according to this design, this sizable axial displacement leads to a disadvantageous position of the center of gravity, and to excessive pitching vibrations, resulting in worsened handling of the hammer.

In order to improve the handling of a hammer having at least moderate electrical power consumption, a different constructive design is known that provides what is known as a spade handle in the area of the percussion mechanism axis, so that the above-mentioned axial displacement assumes only a small value. However, the standardly used universal motors, with collectors, have a relatively long axial length, which, given a positioning of these motors behind a percussion mechanism of the hammer, would lead to a large overall length of the hammer, again adversely affecting the handling of the hammer for the operator. For this reason, up to now it has been standard in larger hammers of this power class to situate the universal motors exclusively perpendicular to the percussion or drill axis.

OBJECTS AND SUMMARY OF THE INVENTION

The underlying object of the present invention is to indicate a manually operated hammer drill and/or paving breaker having compact outer dimensions.

According to the present invention, this object is achieved by a manually operated hammer drill and/or paving breaker having the features of patent claim 1. Advantageous developments of the present invention are defined in the dependent claims.

A manually operated hammer drill and/or paving breaker according to the present invention, hereinafter briefly designated "hammer," comprises an electric motor, a percussion mechanism that can be driven by the electric motor, a housing that accommodates the electric motor and the percussion mechanism, and a handle that is fashioned on the housing in such a way that a grasping position is situated in a extension of a percussion axis of the percussion mechanism. Here, the axis of rotation of the motor shaft of the electric motor is axially parallel with the percussion axis.

The situation of the handle at the level of the percussion axis enables an operation of the hammer without disturbing pitching vibrations, while the orientation of the motor shaft results in a significant reduction of the manufacturing costs, because the number of components required can be reduced significantly. Thus, the inventive design is suitable above all for hammers of the medium power class or higher.

In an advantageous specific embodiment of the hammer, the electric motor can be formed by a three-phase motor, a converter being additionally provided in the housing in order to supply the three-phase motor with power at a suitable current frequency. Due to the three-phase motor, the overall length of the hammer can be reduced significantly in its longitudinal direction, because in comparison to a universal motor a three-phase motor has a shorter construction, due not only to the omission of a collector, but also because this type of motor can also be shorter by the length of one or both motor bearings, because, in contrast to the universal motor, due to the absence of a winding on the rotor protruding significantly past the end surfaces of the rotor laminated core, these bearings can be installed in the area of the winding of the stator.

In an advantageous further development, a wobble shaft device can be provided in the housing that converts a rotational movement of the three-phase motor into a back-and-forth movement for the percussion mechanism, and the three-phase motor can be situated above the wobble shaft device and behind the percussion mechanism, i.e., between the percussion mechanism and the handle, relative to the percussion axis in the horizontal position. Due to the situation of the three-phase motor behind the area of the percussion mechanism, so that the axis of rotation of the motor shaft of the three-phase motor is axially parallel with the main operating direction, there results an advantageously short overall length of the hammer.

Another specific embodiment of the present invention is characterized in that a wobble shaft device is provided in the housing that converts a rotational movement of the three-phase motor into a back-and-forth movement for the percussion mechanism, in which the three-phase motor can be situated underneath the percussion mechanism and underneath the wobble shaft device, relative to the percussion axis in the horizontal position. The resulting overall length of this specific embodiment is extraordinarily short, resulting in excellent handling of the hammer. In a variant of this specific embodiment, the handle fashioned on the housing is a spade handle, and it is possible to situate the three-phase motor in an area of the housing underneath the spade handle.

In the above-cited specific embodiment of the hammer, for reasons of space the converter can have a U-shaped construction, and can be situated above the percussion mechanism and above the wobble shaft device, relative to the percussion axis in the horizontal position. This possible construction of the converter has the advantage that unnecessary empty spaces in the housing can correspondingly be filled by the converter, resulting in compact outer dimensions of the hammer. In addition, in this way the heat losses that arise in the converter can be led away to the outside efficiently via the housing.

In a particularly advantageous specific embodiment of the hammer, a spade handle is fashioned on the housing. In this way, an offset between the main operating direction of the hammer and a grasping point for a dominant hand of the operator can either be greatly reduced or eliminated, which is advantageous with respect to the application of higher pressure forces and a fatigue-free use of the hammer over longer periods of time.

In the above-explained specific embodiments that can have a wobble shaft device, a shorter overall length in the longitudinal direction of the hammer is additionally achieved in that the percussion mechanism is realized as a hollow-piston percussion mechanism, having a hollow drive piston and percussion pistons that can move therein, the wobble shaft device acting as a drive for the hollow-piston percussion mechanism. In relation to percussion mechanisms having a crankshaft and connecting rod, which are standard in this power class, the hollow-piston percussion mechanisms having wobble shaft drives have a much more compact construction in the axial direction.

The particular advantage of the specified hammer is that on the one hand the overall number of mechanical parts can be reduced, and on the other hand the costs for these mechanical parts can be significantly reduced. Thus, it is possible to achieve not only cost advantages but also weight advantages while having functions comparable to those of conventional hammers of this power class. The hammer according to the present invention is therefore extremely advantageous with respect to manufacturing costs, safety, operator comfort, and durability.

Another specific embodiment of the present invention is characterized in that the electric motor is a universal motor. In this specific embodiment, a spade handle can be fashioned on the housing, and in addition the universal motor can be situated in a lower housing frame, i.e., in an area of the housing underneath the spade handle. This arrangement advantageously results in a smaller overall length of the hammer in its longitudinal direction, despite the fact that the design of the universal motor is such that it is longer than the three-phase motor.

BRIEF DESCRIPTION OF THE DRAWINGS

These and other features and advantages of the present invention are explained in more detail below on the basis of exemplary specific embodiments, with reference to the accompanying Figures.

DETAILED DESCRIPTION OF THE REFERRED EMBODIMENTS

Figure 1:
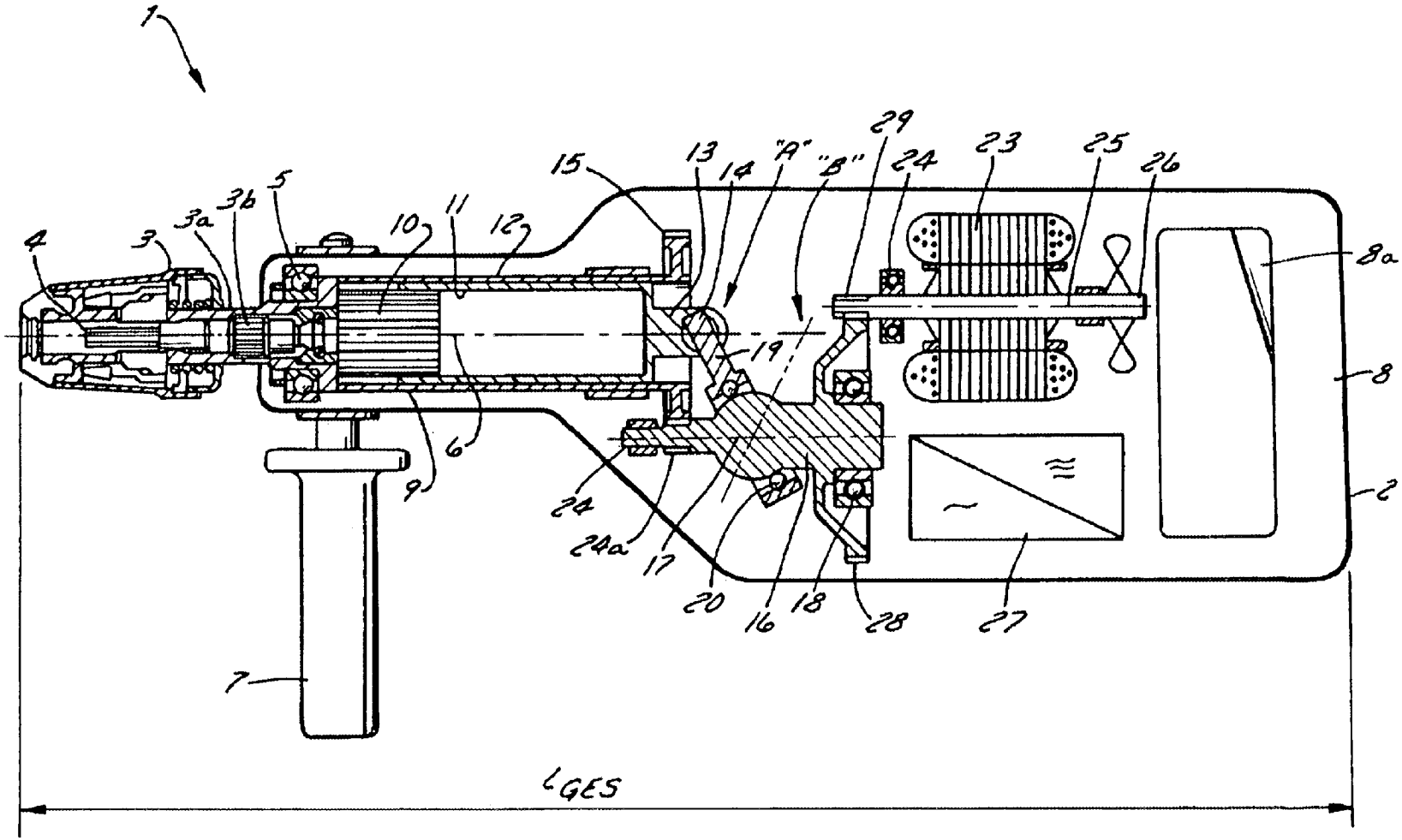
FIG. 1 shows the design of a first specific embodiment of the hammer according to the present invention, in a lateral sectional view.

FIGS. 1 to 4 respectively show the design of first to fourth specific embodiments of a hammer drill and/or paving breaker 1, hereinafter briefly designated "hammer," in lateral sectional view. The first to fourth specific embodiments shown in FIGS. 1 to 4 have in common that a housing 2 is provided in which at one end there is situated a tool holder 3 having a chuck 4, in which a tool (not shown) can be clamped. A shaft 3*a* of tool holder 3 leads into housing 2, and is mounted around a first axis 6 in housing 2 by means of a first bearing device 5. From the views in FIGS. 1 to 4, it can be seen that first axis 6 is parallel to a horizontal main operating direction of hammer 1 that results from the orientation of tool holder 3 and corresponds to the longitudinal or percussion axis of a tool.

For more reliable handling of hammer 1, a handle 7 is attached to housing 2 at the level of first bearing device 5. In its longitudinal direction, handle. 7 extends essentially perpendicular to the main operating direction of the hammer, so that when an operator grasps handle 7 with a hand, he or she can safely support the torque.

At the opposite end of housing 2, a pitcher-type handle or spade handle 8 is formed that the operator can grasp with his or her dominant hand. The spade handle 8 is coupled to housing 2 at two points, i.e., an upper point and a lower point. As can be seen in the Figures, the provision of spade handle 8 ensures that the grasping position, i.e. the dominant hand of the operator, is always situated essentially at the level of, or in prolongation of, first axis 6, and thus also of the axis of percussion, resulting in an advantageous position of the center of gravity and avoidance of vibrations and disadvantageous pitching oscillations around first axis 6. In addition, in an upper area of spade handle 8 an operating switch 8*a* is provided, whose actuation permits the operator to set hammer 1 into operation or out of operation. Operating switch 8*a* is likewise situated approximately in prolongation of the axis of percussion, in order to obtain the desired grasping position.

In addition, all the specific embodiments shown in FIGS. 1 to 4 have in common that a head die 3*b* is situated inside shaft 3*a*, leading into housing 2, of tool holder 3. Head die 3*b* can be moved in shaft 3*a* in a direction parallel to axis 6, or to the main operating direction. In an area in housing 2 behind bearing device 5, relative to the main operating direction or to the axis of percussion, a percussion mechanism 9 is provided that is realized as a hollow-piston percussion mechanism. Here, percussion mechanism 9 has a percussion piston 10, a drive piston 111 that drives percussion piston 10 in a known manner, and a percussion mechanism tube 12, in which the unit made up of percussion piston 10 and drive piston 111 is guided so as to be capable of movement parallel to the axis 6. A longitudinal axis of percussion mechanism 9 is coaxial with first axis 6.

At an end of percussion mechanism 9 opposite tool holder 3, a flange 13 having a guide eye 14 is provided at the end of drive piston 11, and an external toothing 15 is formed on an area of percussion mechanism tube 12 that extends past flange 13.

At its end opposite tool holder 3, percussion mechanism 9 works together with a wobble shaft device 16 that is mounted in housing 2 via a second bearing device 18, and that can be driven in rotational fashion about a second axis 17 parallel to first axis 6. A first peg 19 is provided on a main element of wobble shaft device 16 by means of a third bearing device 20, and extends at an angle to second axis 17. A free end of first peg 19 is mounted in rotational fashion in guide eye 14 of flange 13. In addition, the main element of wobble plate device 16 has a second peg 21 having an external toothing 21*a*, and second peg 21 extends axially parallel to percussion mechanism 9, or to percussion mechanism tube 12, in such a way that external toothing 21*a* of second peg 21 engages with external toothing 15 of percussion mechanism 12.

The above-described wobble plate device 16 makes it possible on the one hand for percussion mechanism tube 12 of percussion mechanism 9 to be set into rotation via second peg 21, resulting in a rotation of tool holder 3 for a drilling function of hammer 1. In addition, during a rotation of wobble plate device 16 about second axis 17, first peg 19 moves continuously from a first operating position "A" to a second operating position "B" and back to first operating position "A." Due to the mounting of the free end of first peg 19 in guide eye 14, flange 13, and thus drive piston 11 of the percussion mechanism, are thus set into a back-and-forth movement parallel to first axis 6.

Through a coupling device (not shown), it can correspondingly be determined whether a rotational movement of a motor (to be described below) is converted into a rotational movement of percussion mechanism tube 12 or into a percussive movement of drive piston 11, and thus of percussion piston 10, or whether there results a superposition of the rotational movement of percussion mechanism tube 12 with the translational back-and-forth movement of drive piston 11 and of percussion piston 10, for a simultaneous drilling and percussion action of hammer 1.

A tool (not shown) can be placed into chuck 4 of tool holder 3 in such a way that it is held therein in positively locking fashion in the radial direction, and is thus capable of movement in the horizontal direction parallel to the main operating direction. Head die 3*b* is constructed such that a first end thereof, facing tool holder 3, is adjacent to chuck 4. A second end of head die 3*b*, facing percussion mechanism 9, extends through shaft 3*a* in such a way that it can come into contact with an end surface of percussion piston 10.

In the case of a drilling function of hammer 1, a rotational movement of percussion mechanism tube 12 is transmitted via shaft 3*a* to tool holder 3, and, due to pressure exerted on a working surface of hammer 1, an end of the tool accommodated in chuck 4 lies against first end of head die 3*b*, which in turn lies with its second end on the end surface of percussion piston 10. The rotation of tool holder 3 is transmitted to the tool placed in chuck 4 in positively locking fashion in a radial direction, so that a drilling function of hammer 1 can be executed.

For the case in which a percussive function of hammer 1 is to be achieved, given a back-and-forth movement of drive piston 11 and of percussion piston 10, the end surface of percussion piston 10 impacts against head die 3*b*, via which this movement is transferred to the tool placed into chuck 4, which can be moved in the horizontal direction parallel to the main operating direction. As mentioned above, the rotational movement of tool holder 3 can unproblematically be superposed with a back-and-forth movement of drive piston 11 and of percussion piston 10, or of head die 3*b*, resulting in a simultaneous drilling and percussive function of hammer 1.

The above-explained features are common to the first through fourth specific embodiments. In the following, the specific embodiments are discussed in detail with respect to their differences.

In FIG. 1, a first specific embodiment of hammer 1 is shown in which a three-phase motor 23 is accommodated in housing 2 via a fourth mounting device 24, above wobble shaft device 16 and behind percussion mechanism 9.

A three-phase motor is in general distinguished in that it has a small dimension in the axial direction due to the omission of the collector, which is standard in universal motors. The axial length of this type of motor can additionally be reduced by the length of the motor bearings, because, in contrast to the universal motor, due to the absence of a winding on the rotor extending far past the end 20 surfaces of the rotor laminated core, these bearings can be installed in the area of the winding of the stator.

A decisive feature of this specific embodiment is that the three-phase motor 23 is accommodated in housing 2 in such a fashion that an axis of rotation 25 of a motor shaft 26 of three-phase motor 23 is 25 axially parallel to first axis 6, or to the main operating direction of hammer 1. The aspects cited above have the result that the overall length $L_{GES}$ of hammer 1 is shorter in its longitudinal direction in relation to other hammers of this power class if, in such hammers, a universal motor were to be installed in such a way that its motor axis was parallel to the main operating direction. In hammers of this class, reductions in length in the range of 50 to 70 mm can be assumed.

In this first specific embodiment, a converter 27 is situated underneath the three-phase motor 23, in an area of the housing between wobble shaft device 16 and spade handle 8, in order to provide three-phase motor 23 with power. Converter 27 can suitably be supplied with single-phase line alternating current, and converts the line current into a current that is suitable for three-phase motor 23.

Motor shaft 26 of three-phase motor 23 has, on one free end situated in alignment with a flange toothing 28 formed on the main element of wobble shaft device 16, an outer toothing 29 that engages with flange toothing 28. In this way, it is possible to transmit the rotation of motor shaft 26 of three-phase motor 23 to wobble plate device 16.

Figure 2:
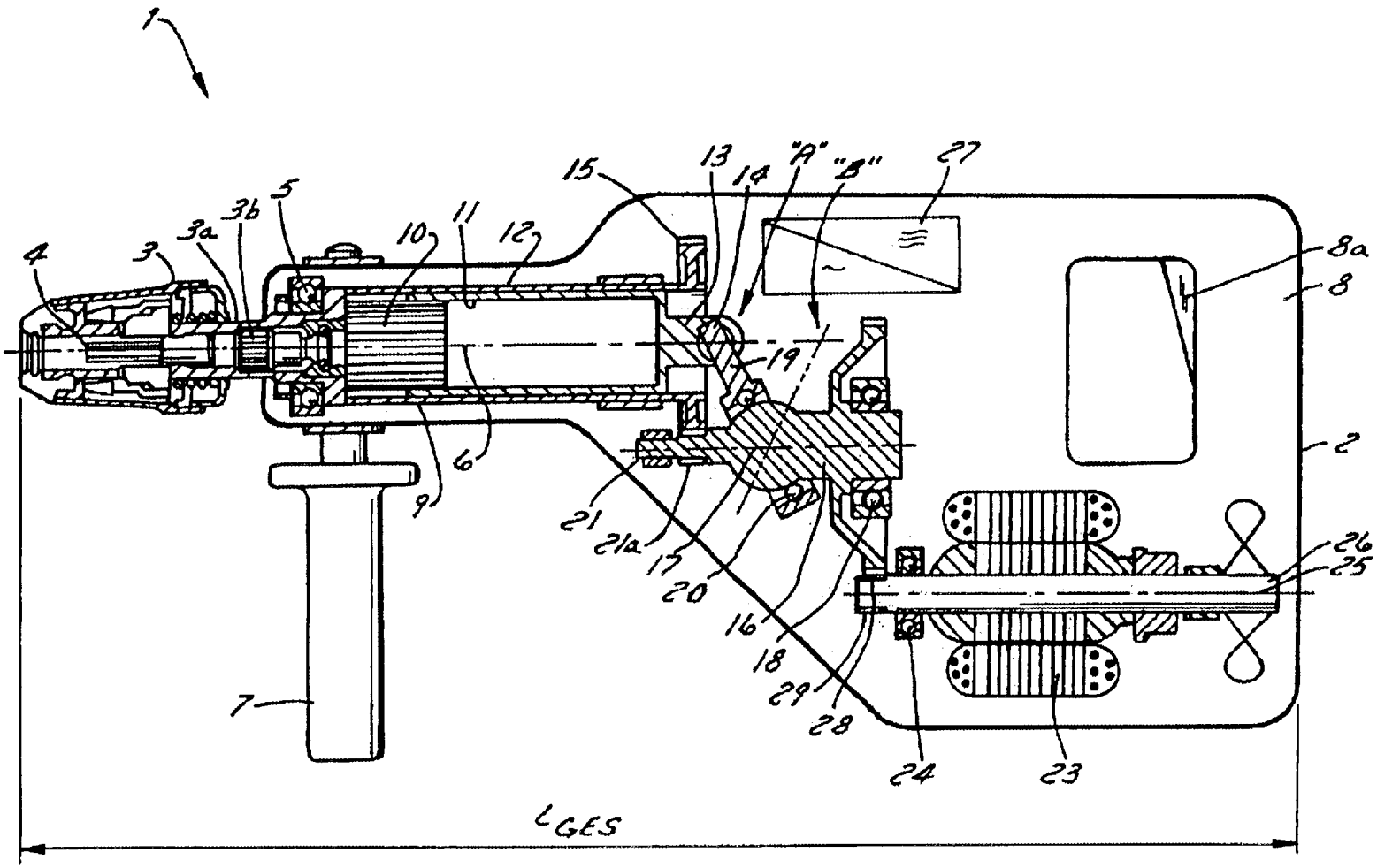
FIG. 2 shows the design of a second specific embodiment of the hammer according to the present invention.

In FIG. 2, a second specific embodiment of the present invention is shown in a lateral sectional view. This second specific embodiment is largely identical with the first specific embodiment, and identical reference characters have been used for identical components, whose description is not repeated below. In contrast to the first specific embodiment, here three-phase motor 23 is situated in an area of housing 2 underneath spade handle 8. Moreover, in the second specific embodiment converter 27 is situated behind percussion mechanism 9 and above wobble plate device 16, relative to the main operating direction.

Figure 3:
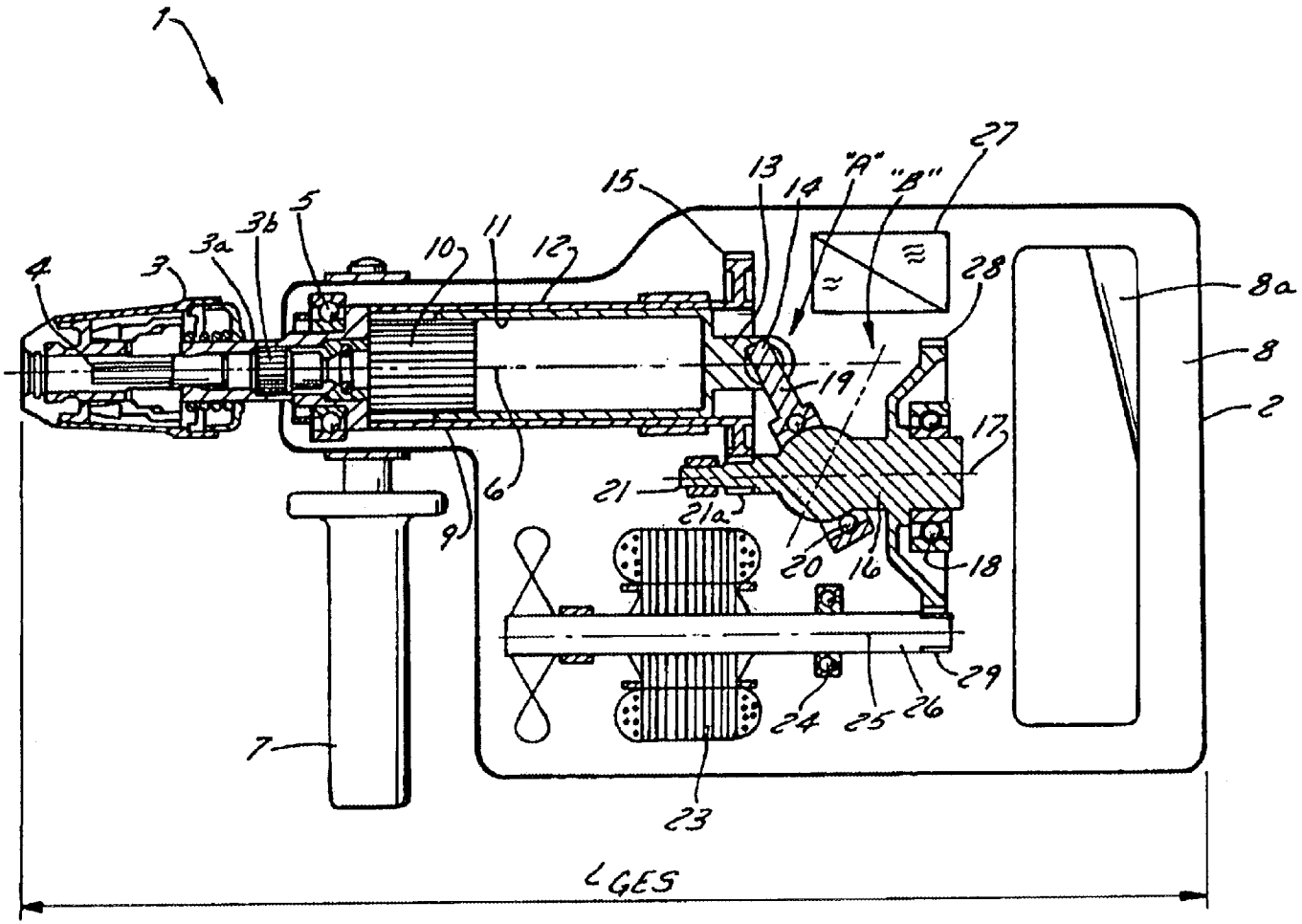
FIG. 3 shows the design of a third specific embodiment of the hammer according to the present invention.

In a third specific embodiment of hammer 1, of whose design FIG. 3 shows a lateral sectional view, an external shape of housing 2 is modified in comparison with the first specific embodiment and the second specific embodiment, in that here the three-phase motor 23 is situated underneath percussion mechanism 9 and underneath wobble plate device 16, relative to the main operating direction. In both the second and the third specific embodiment, converter 27 has a U shape, and is situated above percussion mechanism 9 and above wobble plate device 16, relative to the main operating direction. The U-shaped construction makes it possible for converter 27 to suitably fill intermediate spaces in housing 2, resulting in compact outer dimensions of hammer 1.

In other words, this situation of converter 27 is advantageous because it takes up very little space in housing 2. In addition, due to the U-shape, heat losses that occur in converter 27 are efficiently carried to the outside via housing 2. The remaining components of the third specific embodiment are essentially identical to those of the first and second specific embodiment.

Figure 4:
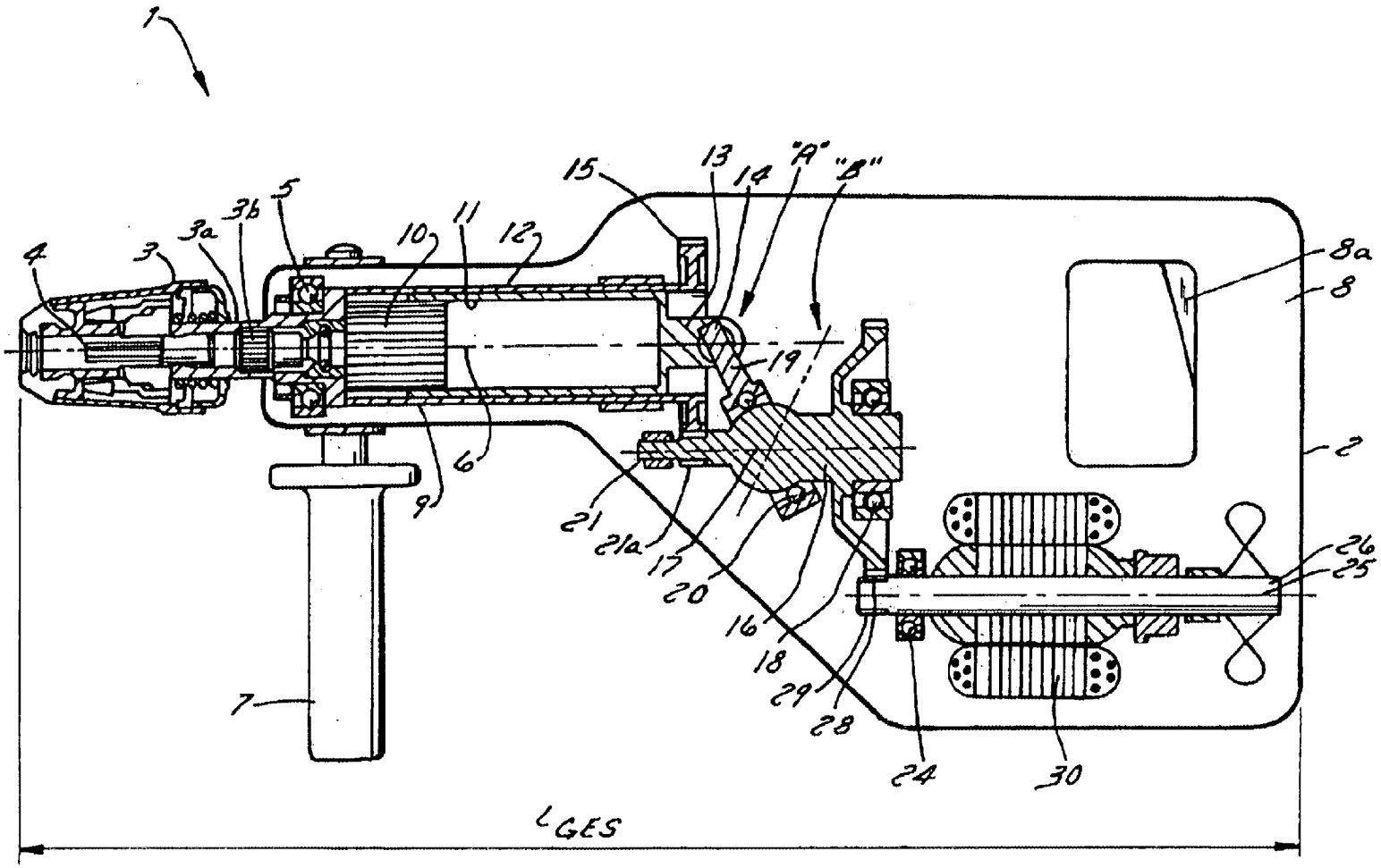
FIG. 4 shows the design of a fourth specific embodiment of the hammer according to the present invention.

In FIG. 4, the design of a fourth specific embodiment is shown that is essentially identical to the above-explained second specific embodiment. In contrast to the second specific embodiment, however, instead of a three-phase motor here a universal motor 30 is accommodated in housing 2, this universal motor having a larger dimension in the axial direction due to a separate motor bearing outside the winding of the stator. However, due to the advantageous situation of the universal motor in housing 2, in which axis of rotation 25 of motor shaft 26 of universal motor 30 is axially parallel to the main operating direction, in the fourth specific embodiment it is likewise possible to achieve a reduced overall length $L_{GES}$ in comparison with hammers of this power class, if in such hammers the electric motor were to be situated in the housing in the manner shown here.

Despite the compact outer dimensions, in the various specific embodiments of hammer 1 according to the present invention the above-explained constructive design permits a generous dimensioning of the essential components, such as for example first to fourth bearing devices 5, 18, 20, 24, first and second pegs 19, 21, and outer toothings 15, 21*a*, 29. This results in a high degree of durability and an advantageously long lifespan, with superior percussive power of hammer 1.

What is claimed is:

1. A hammer drill and/or paving breaker (1), having:

an electric motor (23; 30), a percussion mechanism (9) that can be driven by the electric motor (23; 30), a housing (2) that accommodates the electric motor (23; 30) and the percussion mechanism (9), and having a handle (8) that is fashioned on the housing (2) in such a way that a grasping position is situated at the level of a prolongation of a percussion axis (6) of the percussion mechanism (9);

the axis of rotation (25) of a motor shaft (26) of the electric motor (23; 30) being axially parallel with the percussion axis (6);

characterized in that the electric motor (23; 30) is situated in an area of the housing (2) underneath the handle (8), relative to the percussion axis in a horizontal tool position.

2. The hammer drill and/or paving breaker (1) as recited in claim 1, characterized in that the electric motor is a three-phase motor (23), and that a converter (27) is provided in the housing (2) in order to supply power to the three-phase motor (23).

3. The hammer drill and/or paving breaker (1) as recited in claim 2, characterized in that further comprising (2) a wobble plate device (16) that converts a rotational movement of the three-phase motor (23) into a back-and-forth movement for the percussion mechanism (9).

4. The hammer drill and/or paving breaker (1) as recited in claim 3, characterized in that the converter (27) has a U-shaped construction, and is situated above the percussion mechanism (9), as well as above the wobble plate device (16), relative to the percussion axis in the horizontal tool position.

5. The hammer drill and/or paving breaker (1) as recited in claim 1, characterized in that the electric motor is a universal motor (39).

6. A hammer drill and/or paving breaker (1), having:

an electric motor (23; 30), a percussion mechanism (9) that can be driven by the electric motor (23; 30), a housing (2) that accommodates the electric motor (23; 30) and the percussion mechanism (9), and a handle (8) that is fashioned on the housing (2) in such a way that a grasping position is situated at the level of a prolongation of a percussion axis (6) of the percussion mechanism (9); the axis of rotation (25) of a motor shaft (26) of the electric motor (23; 30) being axially parallel with the percussion axis (6);

characterized in that the electric motor is a three-phase motor (23), a converter (27) is provided in the housing (2) in order to supply power to the three-phase motor (23), and wherein that relative to the percussion axis horizontal tool position, a three-phase motor (23) is situated above the wobble plate device (16) to behind the percussion mechanism (9), and, between the percussion mechanism (9) and the handle (8).

* * * * *